US006502712B1

(12) United States Patent
Weber-Unger

(10) Patent No.: US 6,502,712 B1
(45) Date of Patent: Jan. 7, 2003

(54) DRINKING VESSEL

(76) Inventor: Georg Weber-Unger, Pienzenauerstrasse 15, 8330 Kufstein (AT)

( * ) Notice: Subject to any disclaimer, the term of this patent is extended or adjusted under 35 U.S.C. 154(b) by 24 days.

(21) Appl. No.: 09/652,373

(22) Filed: Aug. 31, 2000

(30) Foreign Application Priority Data

Sep. 2, 1999 (DE) ..... 299 15 432 U

(51) Int. Cl.[7] ..... B65D 25/04; A47G 19/22

(52) U.S. Cl. ..... 220/501; 220/23.83; 220/506; 220/553; 220/719

(58) Field of Search ..... 220/501, 703, 220/710, 719, 506, 23.86, 23.87, 718, 553, 23.83

(56) References Cited

U.S. PATENT DOCUMENTS

| | | | | | |
|---|---|---|---|---|---|
| 293,190 | A | * | 2/1884 | Moore | 220/710 X |
| 445,057 | A | * | 1/1891 | Harroun | 220/23.86 |
| 608,590 | A | * | 8/1898 | Freund | 220/23.87 |
| 962,641 | A | * | 6/1910 | Kaufmann | 220/703 X |
| 1,340,886 | A | * | 5/1920 | Gaelleguillos | 220/703 X |
| 1,393,235 | A | * | 10/1921 | Mitrovich | 215/10 |
| 2,093,657 | A | * | 9/1937 | Harper | 220/23.87 |
| 2,170,311 | A | * | 8/1939 | Smith | 220/501 |
| 2,263,947 | A | * | 11/1941 | Gottfried | 220/710 X |
| 2,297,843 | A | * | 10/1942 | Sharpnack | 220/23.87 |
| 3,379,338 | A | * | 4/1968 | Marks et al. | 220/719 X |
| 3,400,855 | A | * | 9/1968 | Alexander | 220/719 X |
| 3,984,941 | A | * | 10/1976 | Chetta, Jr. | 220/23.87 |
| 4,016,998 | A | * | 4/1977 | Finch | 220/703 X |
| 4,768,674 | A | * | 9/1988 | Prescott | 220/719 X |
| 5,370,258 | A | * | 12/1994 | Fair | 220/501 |

* cited by examiner

*Primary Examiner*—Lee Young
*Assistant Examiner*—Joseph C. Merek
(74) *Attorney, Agent, or Firm*—Henry M. Feiereisen; Ursula B. Day

(57) ABSTRACT

A drinking vessel is provided having the dual purpose of providing in addition to drinking therefrom to also smell the aroma emitted from the drink by providing the drinking vessel with at least one inner element inside the drinking vessel dividing the drinking vessel into drinking compartment from which a drink can be sipped and providing an aroma compartment from which the aroma of the drink can be smelled while drinking from the drinking compartment and that the drinking compartment and the aroma compartment have different configurations.

27 Claims, 3 Drawing Sheets

DRINKING VESSEL

CROSS-REFERENCES TO RELATED APPLICATIONS

This application claims the priority of German Patent Application Serial No. 299 15 432, filed Sep. 2, 1999, the subject matter of which is incorporated herein by reference.

BACKGROUND OF THE INVENTION

The present invention relates in general to a drinking vessel and in particular to a drinking glass used for drinking and tasting beverages of all types including wine, spirits or other alcoholic beverages.

Special drinking glasses for certain beverages are commercially known in the prior art. For example, shaped glasses are known to be used for particular drinks, such as wine glasses that are shaped differently depending on the type of wine that is being consummated. Thus, red wine glasses often differ in shape from white wine glasses. Further examples are champagne glasses and cognac snifters that are especially shaped so they are suitable for these particular drinks and that the aroma of the drink can be appreciated.

It is known that the olfactory sense, which is the sense of smell has an important role in the taste experience of a person. Thus, the taste of food and drink depends also largely on the aroma emitted from the foods and drink being consummated and that is then detected through the sense of smell. Likewise, when tasting wine, spirits or other alcoholic or non-alcoholic beverages, the aroma of a beverage liquid is experienced more intensively when moving the nose closer to the liquid. Generally, the aroma is intensified when the glass holding the drink is brought into close proximity to the nose so that the nose reaches into the opening of the glass for smelling the aroma of the drink. When tasting the beverage, by taking sips, the mouth is brought to the edge of the glass' drinking opening, which moves the nose further away from the glass so that the intensity in sensory intake of the aroma of the drink by way of smell diminishes. Accordingly, it is desirable that the sensation of smelling the aroma of a drink remains unchanged while sipping the drink

SUMMARY OF THE INVENTION

It is thus an object of the present invention to provide an improved drinking vessel, obviating the afore-stated drawbacks.

In particular, it is an object of the present invention to provide an improved drinking vessel which permits a more intense olfactory experience while drinking and tasting the drink, such that the sensation of smelling the aroma of the drink before, during and after sipping the drink is intensified.

These objects, and others which will become apparent hereinafter, are attained in accordance with the present invention by providing a drinking vessel wherein a drinking vessel for a drinking liquid comprises a drinking compartment for providing drinking liquid when the vessel is brought into a drinking position; at least one inner element having a wall area and defining an aroma compartment where drinking liquid is provided for smelling an aroma of the drinking liquid when the drinking vessel is brought into the drinking position.

Suitably, a compartment of the vessel receives a portion of the drinking liquid available for drinking when the drinking vessel is brought into a drinking position and in addition has another compartment with an area for receiving drinking liquid for purposes of only smelling the aroma of the drink. By so providing the drinking vessel with compartments namely the sipping compartment and the aroma compartment, the vessel is optimally suited for a person to have the sensory experience from the aroma of the drink.

It is a further object of the invention to provide a drinking vessel where the aroma compartment of the drinking vessel holds the drinking liquid closely below the nose of the drinking person prior, during and immediately after sipping the drink.

In accordance with the invention, the drinking vessel is provided with a drinking compartment and when brought into a drinking position, drinking liquid is provided at least in the drinking compartment of the drinking vessel for sipping. The drinking vessel also has an inner element with an aroma compartment for holding a portion of the drink. The inner element is configured in such a way that when the drinking vessel is brought into drinking position, a portion of the drinking liquid will be held in the aroma compartment just for smelling.

It is a further feature of the drinking vessel In accordance with the invention that the aroma compartment and the drinking compartment each have an upper end which relative to the drinking vessel are located substantially within the space of the drinking opening of the vessel. Furthermore, to provide an optimum sipping and smelling experience, the location of the aroma compartment may be spaced from the drinking compartment at a distance which is adapted to the average distance between a person's mouth and nose. In this manner, a portion of the drink is thus provided in the aroma compartment of the drinking vessel for smelling the aroma. The afore-stated distance between the aroma compartment and the drinking compartment is approximately about 1 to 4 cm, but preferably about 1.5 cm.

In accordance with a further feature of the invention, the inner element comprises a circumferential wall spaced evenly at an distance from the outer wall of the drinking vessel and concentrically following the circumference of the outer wall of the drinking vessel. Such a rotation symmetrical configuration of the drinking vessel has the added advantage that the drinking vessel is usable both for smelling and sipping in every rotational position and without regard that the vessel must be brought into a particular position when drinking from it.

In accordance with yet another feature of the invention, the inner element is also provided with a wall designed to border the aroma compartment. The bordering wall provides the added advantage that the portion of the liquid within the aroma compartment is retained by the wall to prevent spillage of the liquid therefrom while at the same time the aroma compartment can hold a greater a mount of liquid.

In accordance with the invention, the aroma compartment of the inner element has a surface which can be wetted with liquid.

In accordance with yet another feature of the invention, an aperture is provided between the aroma compartment and the drinking compartment of the drinking vessel so that drinking liquid can move into and out from the drinking compartment into the aroma compartment and vice versa. When filling the drinking vessel or glass, the drinking liquid is thus distributed via the aperture to the drinking compartment and the aroma compartment.

In accordance with a further feature of the invention, the inner element may be configured as a compartmenting wall disposed at the inside wall area of the drinking glass or drinking vessel, where in a simple and reliable manner the inner element is attached to the drinking vessel.

The drinking vessel according to the invention is also particularly suitable for use in wine tasting, since the aroma of the wine is of major significance when judging the quality of wines.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
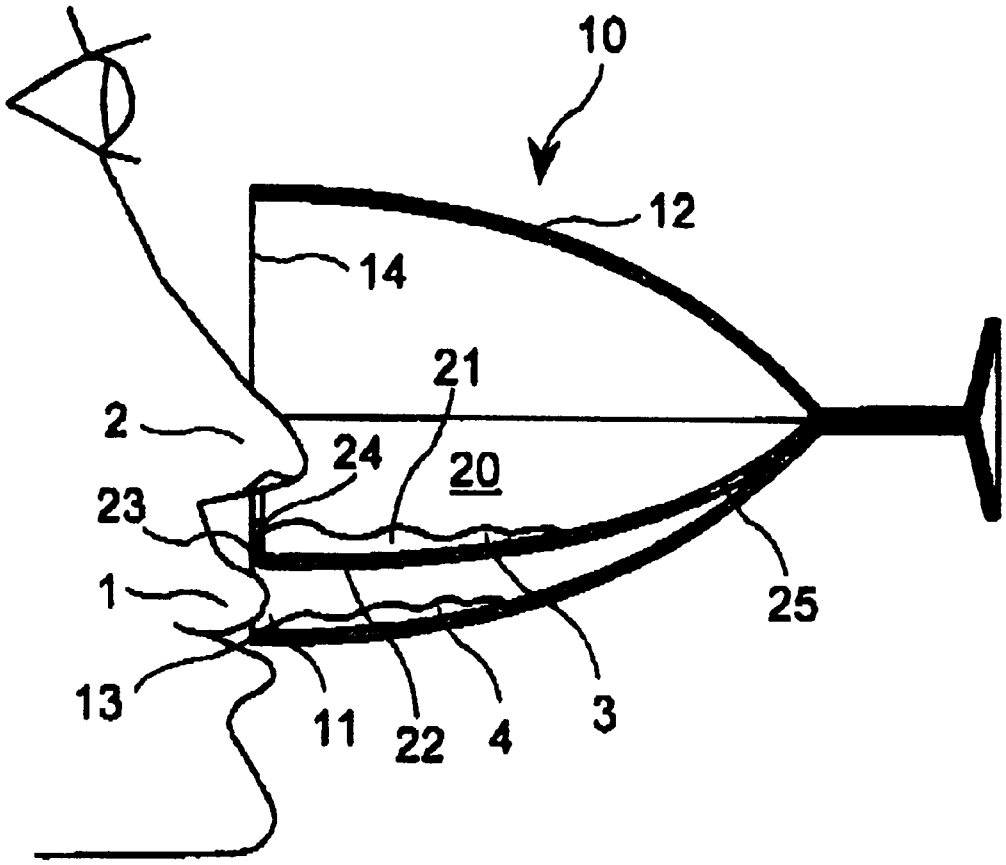
FIG. 1 is a sectional view of a first embodiment of the drinking vessel according to the present invention shown in drinking position with a schematic illustration of a person drinking therefrom.

Throughout all the Figures, same or corresponding elements are generally indicated by same reference numerals.

Turning now to the drawings, and in particular to FIG. 1, there is shown a sectional view of a drinking vessel 10 according to a first embodiment of the invention in a position from which drinking takes place. The schematic view of the head of a person drinking from the glass illustrates the relative position of the person's mouth 1 and nose 2 in relation to the drinking vessel 10. In drinking position as shown in FIG. 1, the drinking vessel 10 is turned to an approximately horizontal position, with the base support of the drinking vessel essentially perpendicular thereto. The person's mouth 1 is shown to be positioned proximate to the drinking compartment 11 of the drinking vessel 10, while at the same time the nose of the drinking person is positioned in close proximity to the aroma compartment. Positioning both the mouth and the nose of the drinking person in this manner provides a very intense sensory experience to the drinking person by both smelling and tasting the drink, before, during and after sipping the drink.

Drinking vessel 10 is configured having an area with an outer wall 12 defining a bowl-shaped compartment of the drinking vessel 10 for holding the drinking liquid. The drinking vessel as shown in FIG. 1 also has a base supporting it. When in standing position, the outer wall of the main body of the drinking vessel extends upwards to an outer edge 13 which circumferentially delimits the opening 14 of the drinking vessel 10. As seen in FIG. 1, drinking vessel 10 comprises a drinking compartment 11, where a portion 4 of the drinking liquid is held which upon tilting the drinking vessel into the drinking position, it is provided to the drinking person for sipping.

In accordance with one embodiment the invention, the drinking vessel comprises an inner element 20 defining an aroma compartment 21, a compartment wall 22, and outer edge 23, a bordering wall 24 and an a connecting aperture 25 connecting the drinking compartment with the aroma compartment.

Inner element 20 is disposed generally in the interior space of the drinking vessel 10. The outer edge 23 of the inner element is positioned essentially within the same vertical plane as the drinking opening 14 of the drinking vessel 10 when in drinking position. The distance of the area inside the outer wall 12 of the drinking vessel to the outer edge 23 of inner element 20 where the mouth of the drinking person is placed during sipping, is slightly less in dimension than the normal distance between the mouth and the nose of the person drinking from the vessel and is approximately between 1 and 4 cm, preferably about 1.5 cm.

Figure 2:
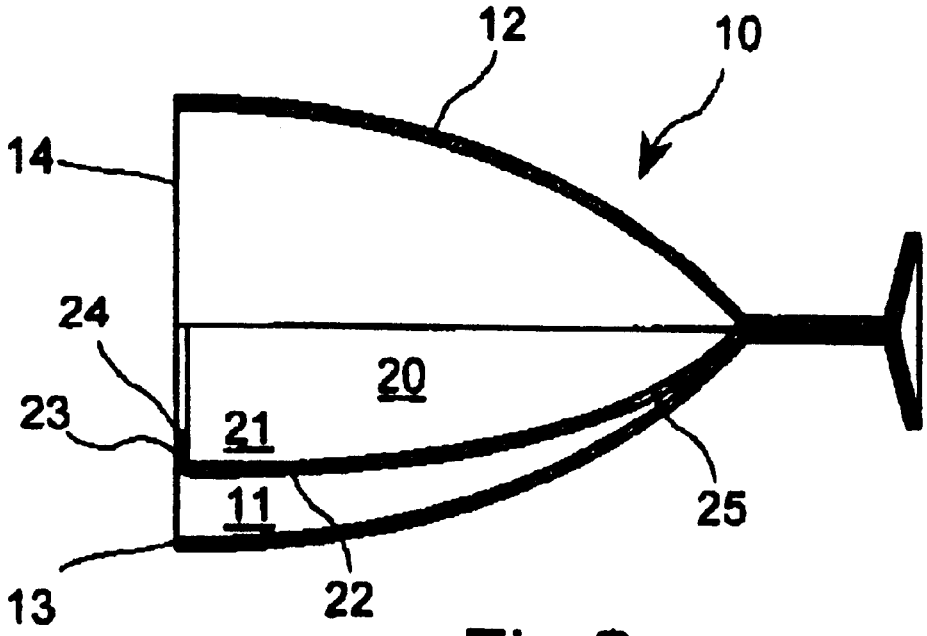
FIG. 2 is the sectional view of the drinking vessel shown in FIG. 1 cut along the axis II—II as shown in FIG. 3.

The aroma compartment 21 of the inner element is configured in such a way as to hold a portion 3 of the drinking liquid within the aroma compartment thereby making the aroma of the drinking liquid available for sensation of smell by the drinking person's nose. The portion 3 of the drinking liquid is held within compartment wall 22 during the drinking position and directly above the drinking area 11 which is formed by the outer wall 12 of the drinking vessel. From the outer edge 23 extends wall 24 in an upward direction when the drinking vessel is held in drinking position as shown in FIGS. 1 and 2. Wall 24 is designed to prevent spillage of the drinking liquid from the aroma compartment onto the drinking person when the drinking person moves the drinking vessel into a drinking position while at the same time the wall 24 holding the liquid portion thereby facilitating the aroma emitted from the drink to reach the nose 2 of the drinking person for sensory uptake.

In an area of inner element 20 of drinking vessel 10 located opposite the drinking opening 14, a connecting opening 25 is arranged by which the aroma compartment connects with the drinking compartment of the drinking vessel. Aperture 25 is arranged at a location such that a suitable portion of the drinking liquid which is to be provided for smelling can enter the aroma compartment 21 when the drinking vessel is positioned in a drinking position. Furthermore, the opening is arranged in such a way that the portion of drinking liquid that transfers into the aroma compartment through the opening is sufficient to only provide enough liquid there for smelling the aroma but that no drinking liquid spills over the wall 24. Moreover, the location of the aperture is arranged such that when the drinking vessel 10 is in the drinking position, at least a portion 3 of the drinking liquid in aroma compartment 21 should remain in an area of the aroma compartment 21 which is away from the opening to the drinking compartment. The location of the connecting aperture 25 may be chosen so that in drinking position, the lower end of the opening 25 and the upper edge of the wall 24 are essentially in the same horizontal plane when the drinking vessel is in the drinking position.

When the drinking vessel 10 is standing on its base support,,the drink is poured into the drinking vessel 10 through the opening 14 of the main body. The drinking liquid spreads within the inner space of the drinking vessel which is adjacent to the base support and defined by the outer wall 12 of the drinking vessel. When tilting the drinking vessel 10 into the drinking position, the major portion 4 of the drinking liquid runs through connecting opening 25 into the drinking compartment 11 and the minor portion 3 of the drinking liquid reaches aroma compartment 21. The connecting opening 25 and the wall area 22 are so configured that when the drinking vessel is tilted into the drinking position, only as much drinking liquid is provided to the aroma area sufficient to provide aroma for a smelling sensation but not to spill over the top of wall 24 of inner element 20. Of course, other configurations of this arrangement are also possible depending on the desired use.

Figure 3:
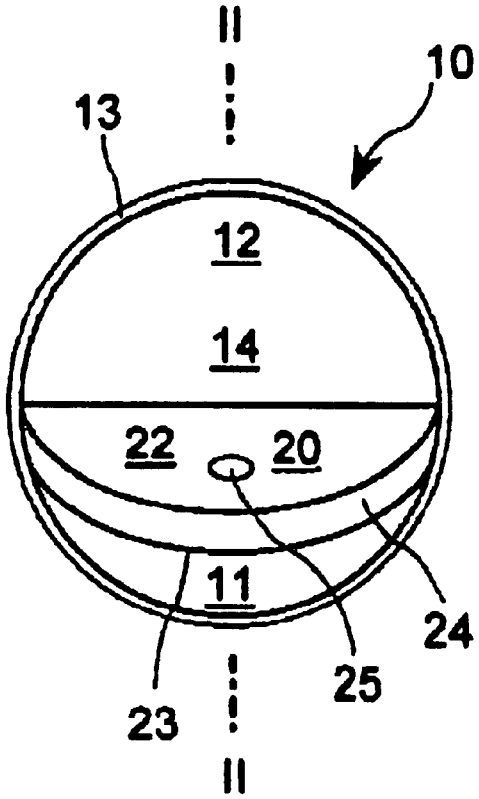
FIG. 3 is a top plan view of the drinking vessel shown in FIG. 2.

FIG. 2 is a sectional view along axis II—II in FIG. 3, of the drinking vessel 10 of FIG. 1 and shown without the depiction of the drinking person. The drinking vessel 10 is configured symmetrically relative to the sectional view. Inner element 20 is shown as being essentially bowl-shaped with each side attached to the inside of outer wall 12 of the drinking vessel along two attachment lines. Each attachment line starts at the outer edge 13 of outer wall 12, which defines the drinking opening of the drinking vessel 10, and extends along the inner surface of the outer wall 12 to the lower end of the inner space of the main body of drinking vessel 10 which defines an area adjacent to the base support. The attachment lines follow an approximate centerline at the outer wall 12.

FIG. 3 shows a top plan view of the drinking vessel 10 of FIG. 2, showing particularly the configuration of the inner element 20. A wall 24 is provided at the outer edge 23 of inner element 20 and within the space defined by outer edge 13 forming the drinking opening 14 of the drinking vessel 10.

The aroma compartment 21 which is not referenced in FIG. 3 and a portion of the wall area 22 which borders the aroma compartment 21 in the direction of the adjacent wall 12, are not seen in FIG. 3 since covered by wall 24. Connecting opening 25 is provided in the wall area 22 and wall 24 follows according to the wall area 22 with its front view covering wall 24, along an arcuate configuration. Wall 22 extends along the entire length of wall 24 bordering at its lower edge. Each side of wall 24 is attached to outer wall 12 and the distance of wall 24 from the outer end 13 of outer wall 12 is widest at the center point and continually tapering off towards the sides.

In accordance with the invention, the embodiment as described and shown in FIGS. 1 through 3 illustrates a way in which a simple and solid attachment of the inner element to the outer wall 12 is realized. The embodiment as shown in FIGS. 1 through 3 has the added advantage that it can be used in the manner afore-described, when it is desired that the drinking liquid is made available for aroma smelling at the same time the drink is being sipped, or it may be used as a conventional drinking glass by a simple turn of 180 degrees.

Figure 3A:
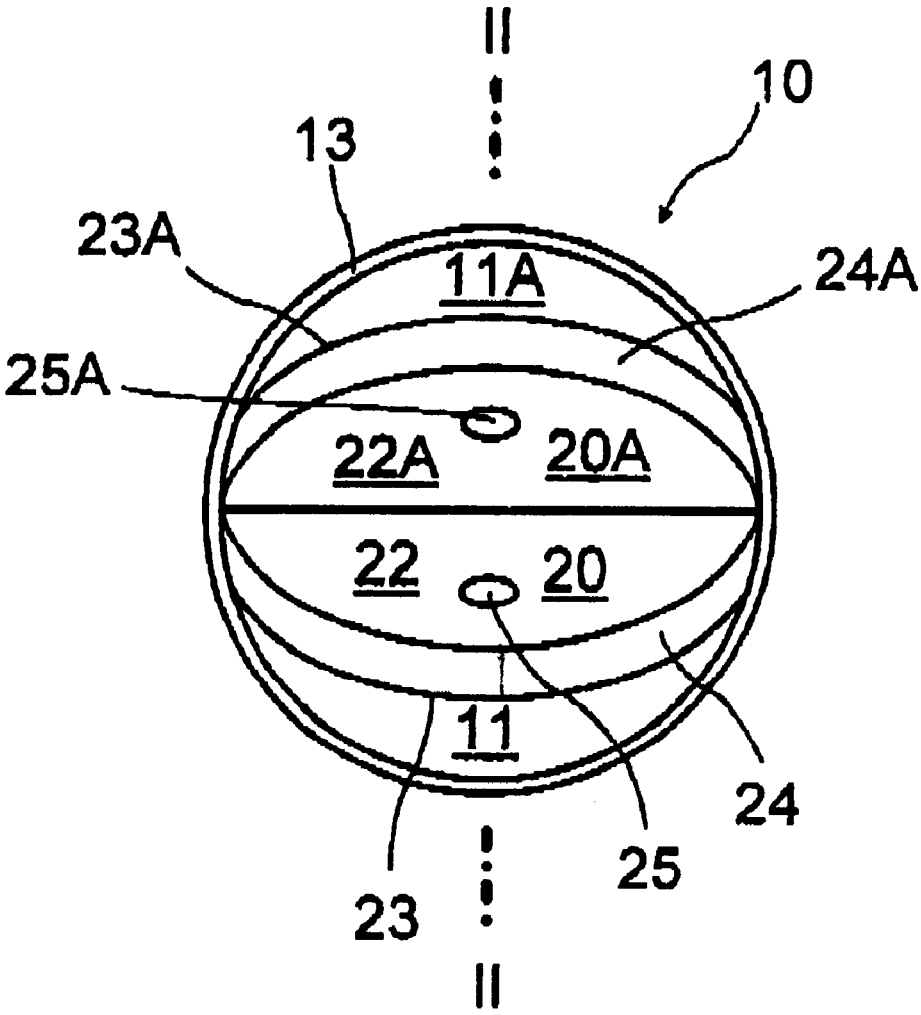
FIG. 3A is a top plan view of a variation of a drinking vessel according to the present invention;.

In a further embodiment of the invention not shown here, the drinking vessel 10 shown in FIGS. 1 to 3 can be modified so as to provide a second inner element identical to the first one, and which is disposed in the interior space of the drinking vessel in a mirror image fashion. Thus, the second element is the same element as is shown by the examples in FIGS. 1 to 3 but in the upper half and above the first inner element, rotated by 180 degrees. This variation is shown in FIG. 3*a,* whereby like parts of the drinking vessel will be identified by corresponding reference numerals, followed by the distinguishing upper case character "A". The drinking vessel of this type can be configured for two drinking positions by attaching the two inner elements in the afore-described simple and solid manner to the drinking vessel. When brought into the proper drinking position, the respective inner element comprising the aroma compartment provides likewise a portion of the drink for intensive sensation of the drink's aroma.

Figure 5:
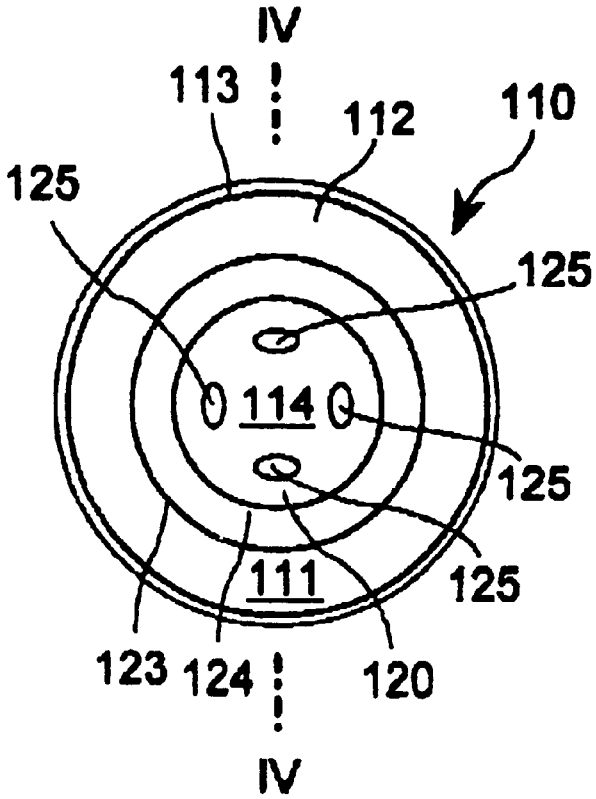
FIG. 5 is a top plan view of the drinking vessel of FIG. 4.
Figure 4:
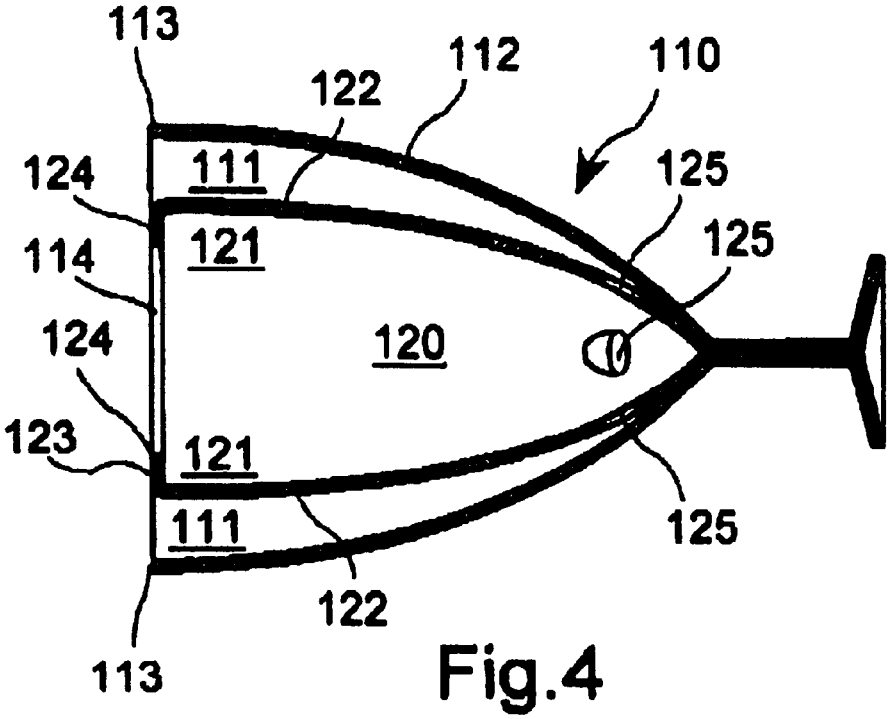
FIG. 4 is a sectional view of another embodiment of the drinking vessel according to the invention cut along the axis IV—IV as shown in FIG. 5.

FIGS. 4 and 5 depict yet another embodiment of the drinking vessel in accordance with the invention, wherein the examples of the drinking vessels shown in FIGS. 4 and 5 shows reference numerals starting with 110. To avoid repetitive elements of the examples shown in FIGS. 1 to 3, only the differences between the two embodiments are being discussed, so that the remarks with respect to identical structures apply here as well.

FIG. 4 shows a drinking vessel 110, similar to the one shown in FIG. 2, but in a compartmental view along an axis IV—IV of the embodiment of the drinking vessel shown in FIG. 5. The drinking vessel 110 shown in FIGS. 4 and 5 differs from the drinking vessel 10 as shown in FIGS. 1 to 3, by the configuration of the inner element 120. A shown in FIG. 4, the inner element is designed as a circumferential wall area 122 and thus essentially forms a separate vessel arranged concentrically within the drinking vessel and having a cross compartmental dimension smaller that the of the entire drinking vessel.

Within the inner space of outer rim 113 forming the opening of the drinking vessel 110, inner element 120 is configured with a circumferential wall 124 which defines the aroma compartment of the drinking vessel.

The inner element 120 divides the aroma compartment from the drinking compartment and by means of connecting openings 125, the two compartments are connected for the passage of drinking liquid therebetween.

Shown in FIG. 5 is a top plan view of the drinking vessel 110 of FIG. 4, where the configuration of inner element 120 of drinking vessel 110 is seen in special detail. A wall 124 delimits the inner element 120 at the outer edge 123 in the area within the space defined by outer rim 113 of drinking opening 14 of drinking vessel 110. The wall covers aroma compartment 121 which is not referenced in FIG. 5 and also covers a portion of wall area 122 which borders the aroma compartment in the direction of the adjacent outer wall 112. Connection openings 125 are located in the wall area 122. Wall 124, according to the partially covered front view of the wall area 122, extends along a circle and is concentrically relative to the outer wall 12. Wall area 122 borders the lower end of wall 124 along the entire length of wall 124 with the distance of wall 124 from the outer edge 113 of wall 112 being substantially uniform.

The aroma compartment 121 and the drinking compartment 111 both extend circumferentially following the opening 114. One advantage of the drinking vessel 110 when configured rotation symmetrical is, that sipping and smelling the drink does not require a specific drinking position of the drinking vessel.

In FIGS. 1 to 5, embodiments of the drinking vessel are shown to have the lower edge of the connecting openings located at a plane that is somewhat higher than the upper edge of wall 24 and 124. This configuration is particularly advantageous for wine tasting glasses. In wine tasting generally, only small portions of wine are being actually tasted. For this purpose, the connecting openings 25 and 125 are disposed at the inner element proximate the part of the vessel or glass that is adjacent to the base support such that a sufficient amount of liquid can enter the aroma compartment 21, 121 when drinking vessel 10, 110 is brought into a drinking position.

The inner element can also be configured differently depending on the purpose of the drinking vessel. For example, if the drinking vessel is used as a general wine glass, more drinking liquid would normally be poured into the glass and the apertures should therefore be designed substantially larger than if the glass were used for wine tasting. Particularly, while in drinking position, the lower edge of the connecting opening should be located at a point slightly below the upper edge of the wall, so that excess drinking liquid that may be received in the aroma compartment can move through the connecting aperture into the drinking compartment and thereby avoid possible spillage of the drink.

While the invention has been illustrated and described as embodied in a drinking vessel, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A drinking vessel, comprising:

a main body defining a center axis; and an inner element positioned in the main body defining two open top compartments connected by at least one aperture, said compartments including a radially outer drinking compartment configured to provide a liquid for a user when the main body is brought into a drinking position, and a radially inner aroma compartment adapted for receiving liquid to enable the user to sense an aroma of the liquid when the main body is brought into the drinking position, said inner element having a user-distal end and a user-proximal end, wherein the inner element has a concave configuration to direct liquid toward a center of the aroma compartment and includes at the user-proximal end a wall which extends upwards, when the main body is in drinking position so as to retain liquid in the aroma compartment and to allow aroma of the liquid to reach the user's nose.

2. The drinking vessel of claim 1, wherein the main body has a drinking opening, said aroma and drinking compartments having outer ends positioned in an area of the drinking opening.

3. The drinking vessel of claim 1, wherein the open top of the aroma compartment is spaced from the open top of the drinking compartment at a distance which is less than a distance between the user's mouth and nose.

4. The drinking vessel of claim 3, wherein the distance is in the range of about 1 to 4 cm.

5. The drinking vessel of claim 4, wherein the distance is 1.5 cm.

6. The drinking vessel of claim 1, wherein the inner element has a wall area extending over a portion of a circumference of the main body at a distance to an outer wall of the main body.

7. The drinking vessel of claim 1, and further comprising a second of said inner element, said inner elements so configured and positioned that the aroma compartment of each inner element receives liquid for sensing by the user when the main body is brought into the drinking position.

8. The drinking vessel of claim 1, wherein the main body has a circumference, said inner element having a circumferential wall which extends about the entire circumference of the main body at a distance to an outer wall of the main body.

9. The drinking vessel of claim 1, wherein the inner element has a wall area in parallel relationship to an outer wall of the main body.

10. The drinking vessel of claim 9, wherein the wall area of the inner element defines the aroma compartment, with liquid being received therein for sensing the drinking portion of the main body.

11. The drinking vessel of claim 1, wherein the inner element has a circumferential configuration.

12. The drinking vessel of claim 2, wherein the inner element has a wall in the area of the opening of the main body.

13. The drinking vessel of claim 12, wherein the aroma compartment is bounded by the wall.

14. The drinking vessel of claim 1, wherein the inner element has a surface in the aroma compartment, said surface being wettable with liquid.

15. The drinking vessel of claim 1, wherein the inner element has at least one aperture for fluidly connecting the aroma compartment and the drinking compartment.

16. The drinking vessel of claim 1, wherein the aperture is provided at a location distal to the open top of the compartments.

17. The drinking vessel of claim 1, wherein the inner element is secured to the main body at a location distal to the open top of the compartments.

18. The drinking vessel of claim 1, wherein the inner element is secured to an outer wall of the main body.

19. The drinking vessel of claim 18, wherein the inner element is secured to the outer wall along two lines which extend from the opening of the main body in the direction toward an opposite end of the main body.

20. The drinking vessel of claim 1, for use as a drinking glass.

21. The drinking vessel of claim 1, for use as a drinking glass for consumption of wine or spirits.

22. A drinking vessel, comprising:

a main body defining a center axis; and a pair of inner elements positioned as mirror images in the main body defining three open top compartments, said compartments including two radially outer drinking compartments intended to provide a liquid for a user when the main body is brought into a drinking position, and a radially inner aroma compartment adapted for receiving liquid to enable the user to sense an aroma of the liquid when the main body is brought into the drinking position, wherein each inner element has an aperture therein connecting the drinking compartments with the aroma compartment, each said inner element having a user-distal end and a user-proximal end, wherein each inner element includes at the user-proximal end a wall which extends upwards, when the main body is in drinking position so as to retain liquid in the aroma compartment and to allow aroma of the liquid to reach the user's nose.

23. The drinking vessel of claim 22, wherein the inner elements are disposed at substantially same angular distances about the circumference of the main body.

24. A drinking vessel, comprising;

a main body; and an inner element positioned in the main body defining two concentric open top compartments connected by at least one aperture, said compartments including a radially outer drinking compartment configured to provide a liquid for a user when the main body is brought into a drinking position, and a radially inner aroma compartment adapted for receiving liquid to enable the user to sense an aroma of the liquid when the main body is brought into the drinking position, said inner element having a user-distal end and a user-proximal end, wherein the inner element includes at the user-proximal end a wall which extends upwards, when the main body is in drinking position so as to retain liquid in the aroma compartment and to allow aroma of the liquid to reach a user's nose.

25. The drinking vessel of claim 24, wherein the open top of the aroma compartment is spaced from the open top of the drinking compartment at a distance which is in the range of about 1 to 4 cm.

26. The drinking vessel of claim 25, wherein the distance is 1.5 cm.

27. The drinking vessel of claim 24, wherein the inner element has a surface in the aroma compartment, said surface being wettable with liquid.

* * * * *